US009827686B2

(12) United States Patent
Raymond

(10) Patent No.: US 9,827,686 B2
(45) Date of Patent: Nov. 28, 2017

(54) UTILITY KNIFE WITH BLADE PROTECTOR

(71) Applicant: Daniel J. Raymond, Saginaw, MI (US)

(72) Inventor: Daniel J. Raymond, Saginaw, MI (US)

(73) Assignee: DAN-O-TOOL, LLC, Saginaw, MI (US)

( * ) Notice: Subject to any disclaimer, the term of this patent is extended or adjusted under 35 U.S.C. 154(b) by 39 days.

(21) Appl. No.: 14/806,905

(22) Filed: Jul. 23, 2015

(65) Prior Publication Data

US 2016/0023364 A1 Jan. 28, 2016

Related U.S. Application Data

(60) Provisional application No. 62/028,181, filed on Jul. 23, 2014.

(51) Int. Cl.

| | |
|---|---|
| ***B26B 29/02*** | (2006.01) |
| ***B26B 29/00*** | (2006.01) |
| ***B26B 5/00*** | (2006.01) |
| ***B26B 1/08*** | (2006.01) |

(52) U.S. Cl.

CPC ..... *B26B 29/02* (2013.01); *B26B 1/08* (2013.01); *B26B 5/00* (2013.01); *B26B 5/005* (2013.01); *B26B 29/00* (2013.01)

(58) Field of Classification Search

CPC ..... B26B 29/00; B26B 29/02; B26B 29/025; B26B 5/00; B26B 5/005

USPC ..... 30/151, 286

See application file for complete search history.

(56) References Cited

U.S. PATENT DOCUMENTS

| | | | | |
|---|---|---|---|---|
| 142,942 A * | 9/1873 | Ratelle | B26B 27/00 30/289 |
| 2,784,489 A | 3/1957 | Reise | |
| 3,879,847 A * | 4/1975 | Roll | B26B 5/001 30/162 |
| 3,943,627 A | 3/1976 | Stanley, Jr. | |

(Continued)

FOREIGN PATENT DOCUMENTS

| | | | |
|---|---|---|---|
| DE | 3116354 A1 * | 11/1982 | B26B 29/02 |
| FR | 2849796 * | 9/1873 | |

(Continued)

OTHER PUBLICATIONS

English Translation of WO2004069497.*

International Search Report, dated Oct. 7, 2015 (PCT/US2015/041686).

*Primary Examiner* — Jennifer Swinney

(74) *Attorney, Agent, or Firm* — Dickinson Wright, PLLC

(57) ABSTRACT

The utility knife assembly includes a housing which extends in a longitudinal direction between opposite ends and presents an at least partially open interior. A blade with a sharp edge is fixed with the housing such that the blade extends through one of the longitudinal ends, and the blade is fixed with the housing in such a manner that it is non-movable relative to the housing. A blade protector is partially disposed in the open interior of the housing and is movable in the longitudinal direction relative to the housing between a retracted position and a covering position. In the retracted position, the sharp edge of the blade outside of the housing is exposed for cutting, and in the covering position, the sharp edge of the blade outside of the housing is covered by the blade protector.

4 Claims, 5 Drawing Sheets

(56) References Cited

U.S. PATENT DOCUMENTS

| | | | | | |
|---|---|---|---|---|---|
| 4,086,698 | A * | 5/1978 | Sparks | B26B 29/02 | 30/2 |
| 4,091,537 | A * | 5/1978 | Stevenson, Jr. | B26B 29/02 | 30/151 |
| 4,713,885 | A * | 12/1987 | Keklak | B26B 5/003 | 30/162 |
| 4,757,612 | A * | 7/1988 | Peyrot | B26B 29/02 | 30/151 |
| 5,207,696 | A * | 5/1993 | Matwijcow | A61B 17/3211 | 30/151 |
| 6,070,326 | A * | 6/2000 | Berns | B26B 29/02 | 30/2 |
| 6,484,404 | B1 * | 11/2002 | Kao | B26B 5/002 | 30/162 |
| 6,543,140 | B1 * | 4/2003 | Davis | B26B 29/02 | 30/162 |
| 7,596,867 | B1 * | 10/2009 | Biolchini, Jr. | B26B 5/001 | 30/125 |
| 2002/0124418 | A1 * | 9/2002 | Votolato | B26B 5/00 | 30/294 |
| 2004/0177514 | A1 | 9/2004 | Kaczorowski | | |
| 2005/0193568 | A1 * | 9/2005 | Peyrot | B26B 5/001 | 30/162 |

FOREIGN PATENT DOCUMENTS

| | | | | |
|---|---|---|---|---|
| FR | 2612111 | A1 * | 9/1988 | B26B 3/08 |
| FR | WO 2004069497 | A1 * | 8/2004 | B26B 5/001 |
| WO | 9907526 | A1 | 2/1999 | |

* cited by examiner

UTILITY KNIFE WITH BLADE PROTECTOR

CROSS REFERENCE TO RELATED APPLICATION

This U.S. Utility Patent Application claims the benefit of and priority to U.S. Provisional Patent Application Ser. No. 62/028,181 filed Jul. 23, 2014, the entire disclosure of the application being considered part of the disclosure of this application, and hereby incorporated by reference.

BACKGROUND OF THE INVENTION

1. Field of the Invention

The present invention is related generally to utility knife assemblies.

2. Related Art

The utility knife is a common tool used by drywall workers, construction workers, handymen and other people for cutting various things, such as drywall. Utility knives generally include a handle which a user holds during use and a blade for cutting. Most utility knives are either fixed blade knives or retractable blade knives.

Retractable blade knives are advantageous because they allow a user to retract and hide the blade within an open interior of the housing. As such, the user may put retract the blade into the housing and put the utility knife in his or her pocket without fear of injury from an exposed blade. However, retractable blade knives present some disadvantages. For example, a retraction mechanism in the housing may not hold the blade with sufficient security for some uses. In other words, the blades of retractable utility knives may move or rattle relative to the housing during use, which may make it difficult to make precise cuts through certain things, e.g., drywall.

While the housings of fixed blade knives more securely and tightly hold their blades, such fixed blade knives must be handled with extreme care because the blade projects out of the housing and cannot be retracted into the interior of the housing. Covers which are separate pieces from the knives are available to protect the blades of fixed blade knives. However, such covers can easily be misplaced or forgotten, thereby leaving the fixed blade knife with an unprotected and potentially dangerous exposed blade.

SUMMARY OF THE INVENTION AND ADVANTAGES

According to one aspect of the present invention, an improved utility knife assembly is provided. The utility knife assembly includes a housing which extends in a longitudinal direction between opposite ends and presents an at least partially open interior. A blade with a sharp edge is fixed with the housing such that the blade extends through one of the longitudinal ends, and the blade is fixed with the housing in such a manner that it is non-movable relative to the housing. A blade protector is partially disposed in the open interior of the housing and is movable in the longitudinal direction relative to the housing between a retracted position and a covering position. In the retracted position, the sharp edge of the blade outside of the housing is exposed for cutting, and in the covering position, the sharp edge of the blade outside of the housing is covered by the blade protector.

The utility knife assembly is advantageous because it combines the safety of a retractable blade knife with the performance of a fixed blade knife in one compact and intuitive to use package. Specifically, the non-movable connection between the blade and the housing allows for precise cuts to be made, and the blade protector allows a user to put the utility knife in his or her pocket when not in use without fear of injury. Because the blade protector is built into the utility knife assembly, it cannot be lost or misplaced as often happens with separate cover pieces for fixed blade utility knives.

According to a further aspect of the present invention, the blade protector is generally J-shaped with a long leg, or a protector portion, and a short leg, or an actuator portion. A button is disposed on the actuator portion and projects through the housing. Depressing the button has the effect of unlocking the longitudinal movement of the blade protector between the retracted and covering positions. The protector portion presents a channel for receiving and cradling the sharp edge of the blade when the blade protector is in the covering position. The button provides increased intuitiveness to the utility knife assembly as it functions similarly to most retractable knife blades which utilize a button to control movement of the blade.

According to yet another aspect of the present invention, the housing is provided with at least one detent which cooperates with the button to releasably lock the blade protector in the covering position.

According to still another aspect of the present invention, the housing presents a slot through which the button extends, and the slot extends longitudinally to define a range of movement for the blade protector between the covering and retracted positions.

Another aspect of the present invention relates to a method of protecting a sharp edge of a blade of a utility knife. The method includes the step of preparing a utility knife assembly including a housing which extends in a longitudinal direction between opposite longitudinal ends and a blade with a sharp edge. The blade is non-movably fixed with the housing and extends through one of the longitudinal ends of the housing. The method continues with the step of moving a protector portion of a blade protector from within the housing through one of the longitudinal ends to cover the portion of the sharp edge of the blade which is outside of the housing.

BRIEF DESCRIPTION OF THE DRAWINGS

These and other features and advantages of the present invention will be readily appreciated, as the same becomes better understood by reference to the following detailed description when considered in connection with the accompanying drawings wherein.

DESCRIPTION OF THE ENABLING EMBODIMENT

Figure 1:
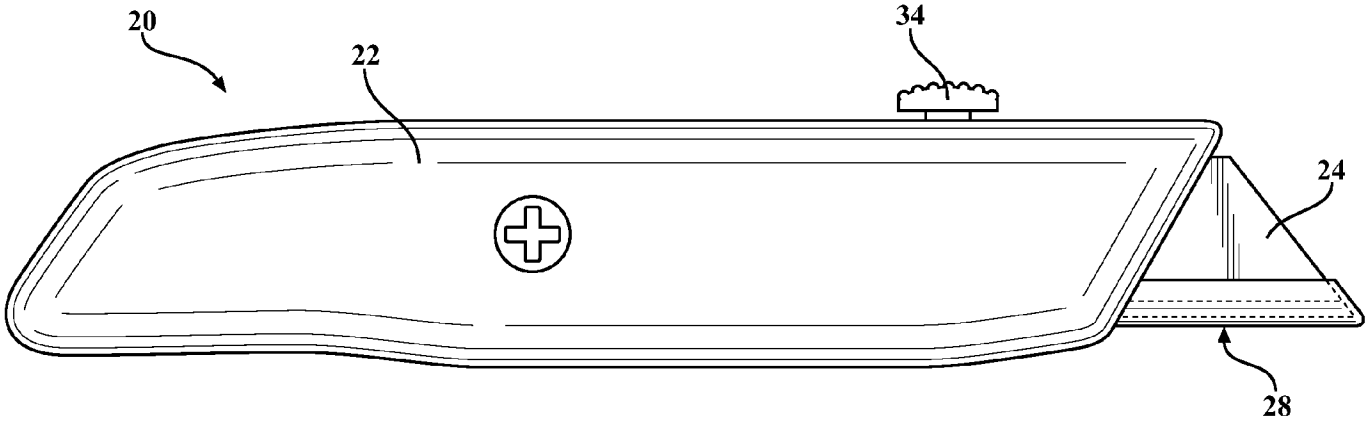
FIG. 1 is a front elevation view of an exemplary embodiment of a utility knife assembly with a blade protector in a covering position.
Figure 2:
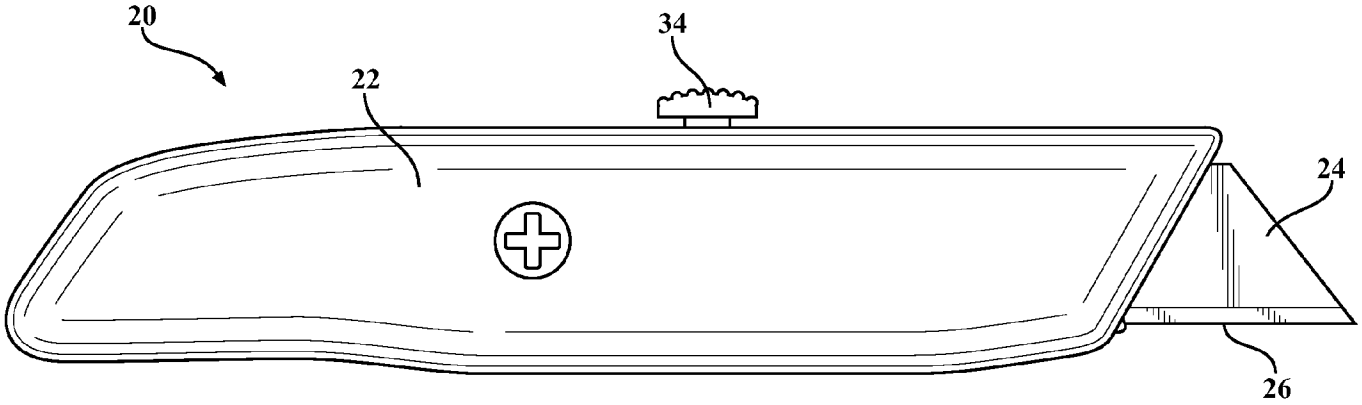
FIG. 2 is a front elevation view of the exemplary embodiment of the utility knife assembly with the blade protector in a retracted position.

Referring to the Figures wherein like numerals indicate corresponding parts throughout the several views, an exemplary embodiment of an improved utility knife assembly 20 is generally shown in FIGS. 1 and 2. The exemplary utility knife assembly 20 includes a housing 22 and a blade 24 with a sharp edge 26. The blade 24 is rigidly anchored to the housing 22 such that movement between the blade 24 and the housing 22 is restricted, i.e., the blade 24 is not retractable. As such, the exemplary utility knife assembly 20 provides for the advantages found in fixed blade knives. Specifically, the more rigidly secured blade 24 allows for improved cutting precision as compared to conventional retractable blade knives. However, unlike conventional fixed blade knives, the exemplary utility knife assembly 20 also includes a blade protector 28, which is a separate piece from the blade 24, for covering the sharp edge 26 of the blade 24 when the utility knife assembly 20 is not in use. The blade protector 28 is retractable into and out of the open interior of the housing 22 for allowing a user to quickly and easily protect or expose the sharp edge 26 of the blade 24. The utility knife assembly 20 is shown with the blade protector 28 in a covering or protected position in FIG. 1 and in a retracted or exposed position in FIG. 2. When in the retracted position shown in FIG. 2, the blade protector 28 is entirely or substantially entirely disposed in the open interior of the housing 22 so that it does not interfere with any cutting operations being performed by the sharp edge 26 of the blade 24.

Figure 3:
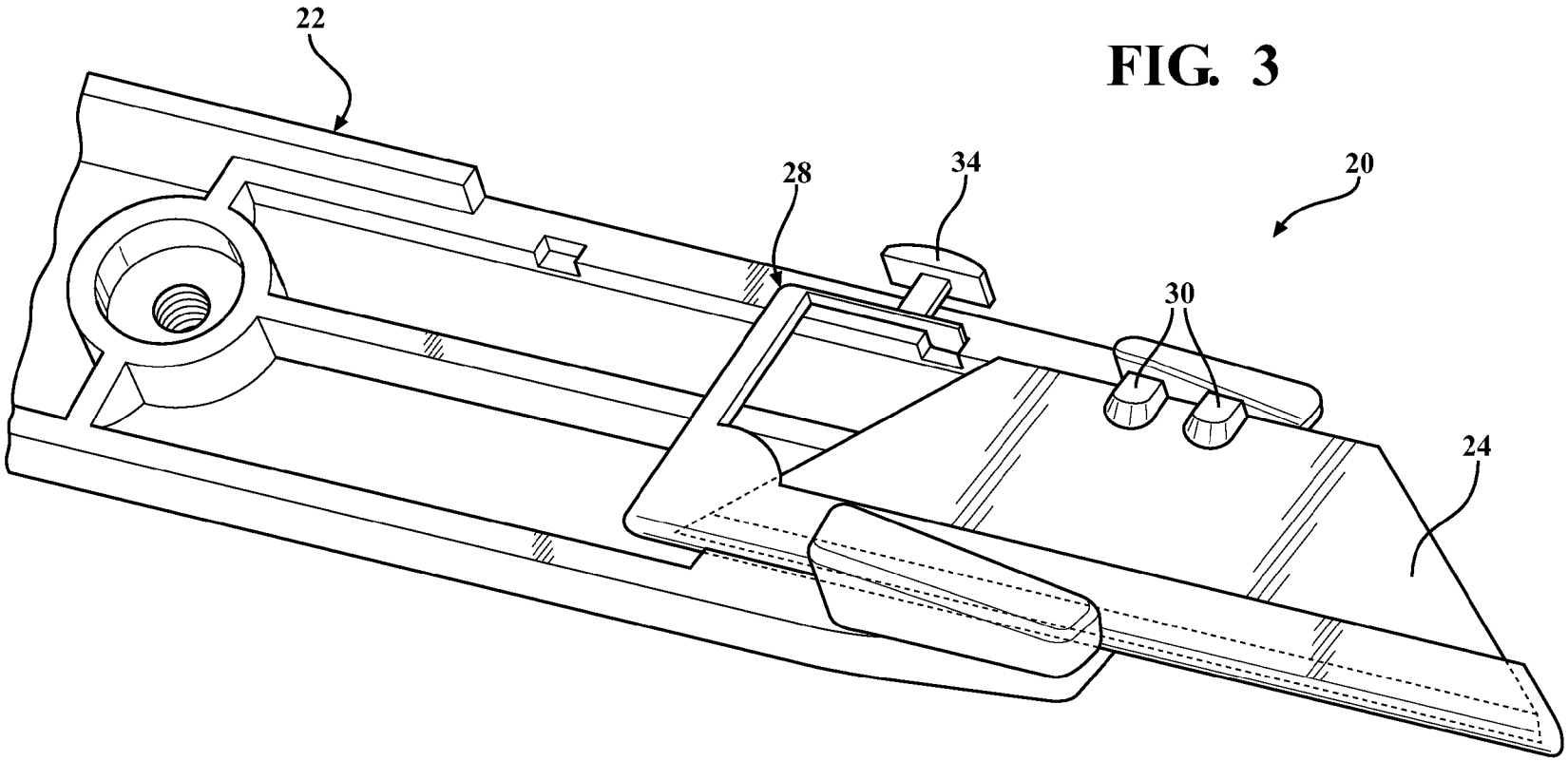
FIG. 3 is a fragmentary view showing the blade protector in the interior of a housing of the utility knife assembly and with the blade protector being in the covering position.
Figure 4:
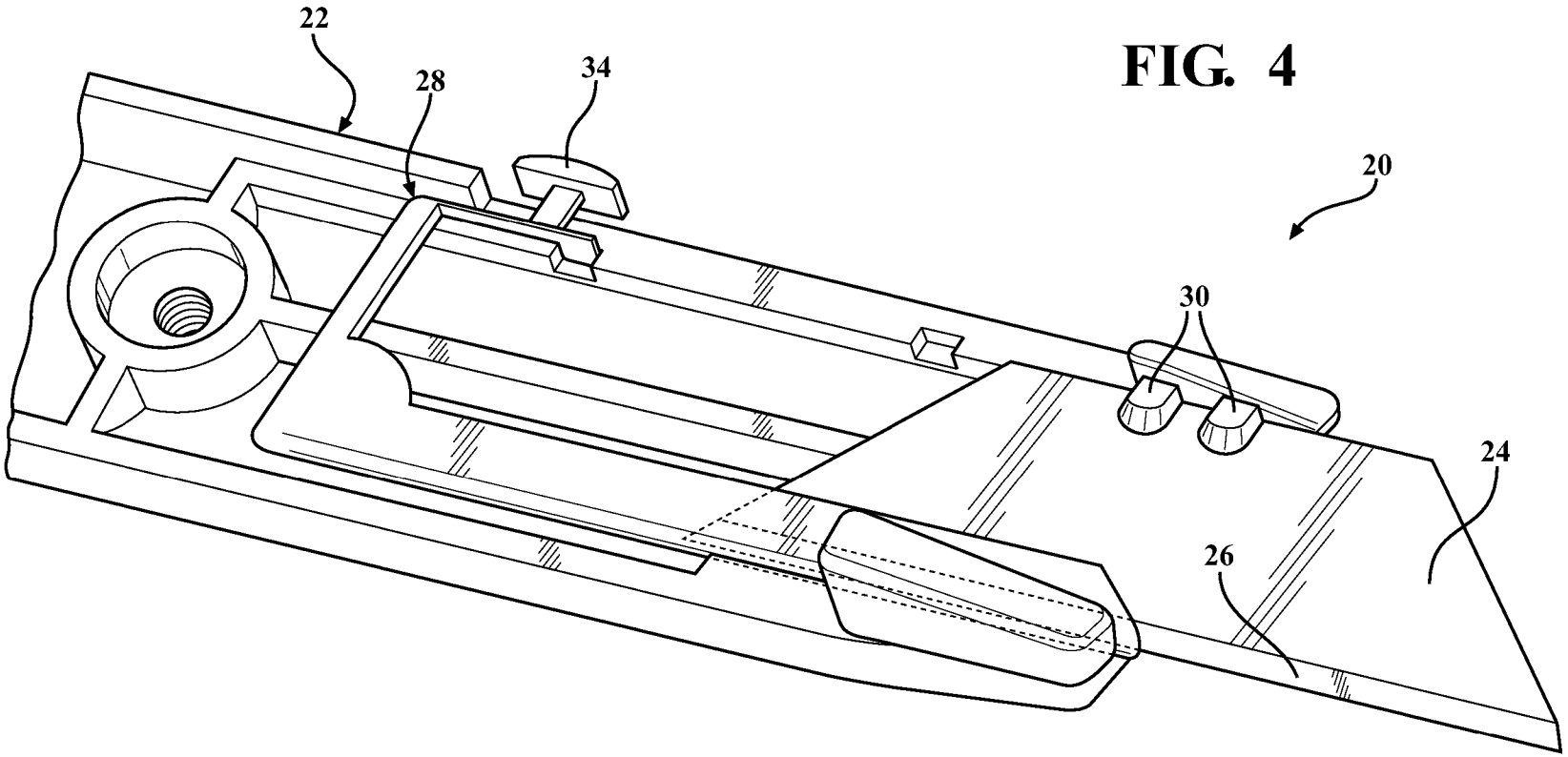
FIG. 4 is a fragmentary view showing the blade protector in the interior of the housing of the utility knife assembly and with the blade protector being between the retracted and covering positions.

Referring now to FIGS. 3 and 4, the blade 24 of the exemplary utility knife assembly 20 is engaged with the housing 22 by a pair of blade engaging features 30 which are formed integrally with the housing 22 and which hold the blade 24 in a predetermined position with a portion of the blade 24 projecting outwardly through one longitudinal end of the housing 22. The blade 24 is immovably and securely anchored to the housing 22 by the blade engaging features 30. This allows for improved performance of the utility knife assembly 20 as compared to retractable blade knives. In the exemplary embodiment, the blade engaging features 30 are a pair of projections which are shaped to be received within correspondingly-shaped recesses in the blade 24.

Figure 5:
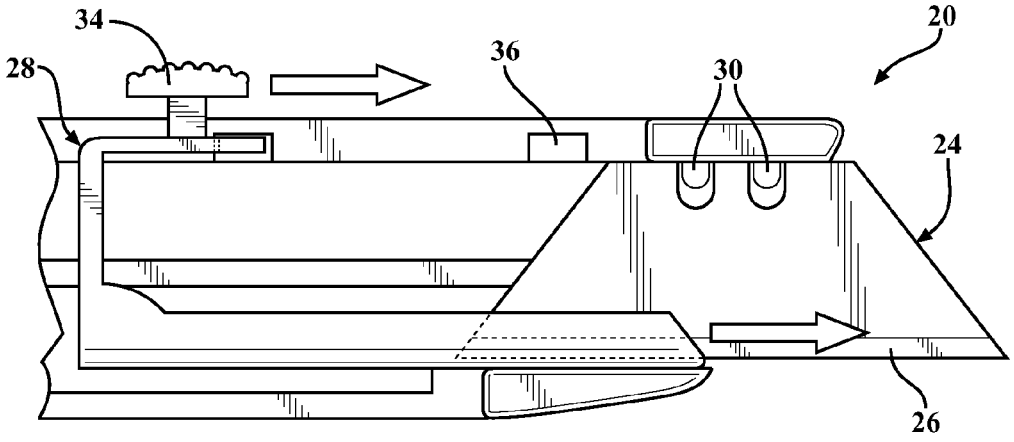
FIG. 5 is a fragmentary view showing the blade protector being in the retracted position.
Figure 6:
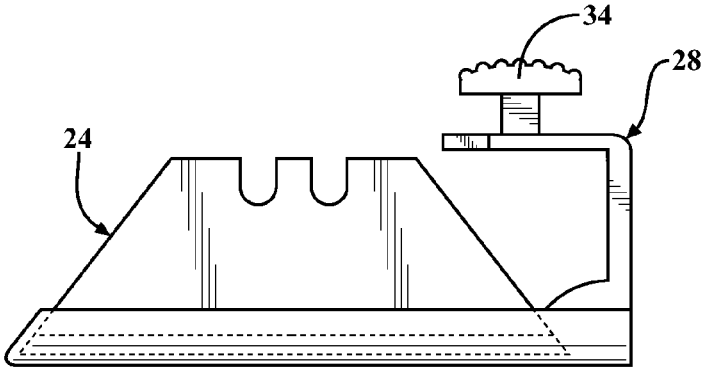
FIG. 6 is a front elevation view showing the exemplary blade protector in engagement with a blade.
Figure 7:
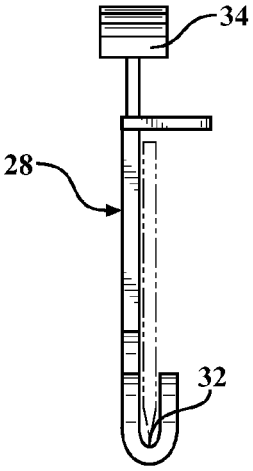
FIG. 7 is a side view of the exemplary blade protector.
Figure 8:
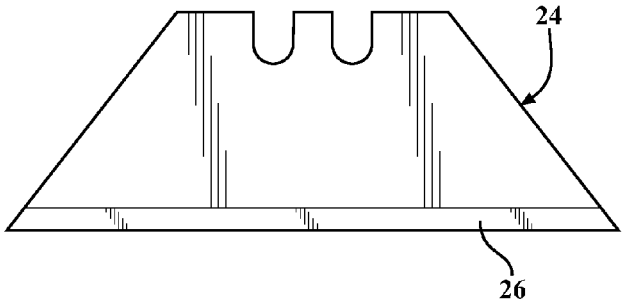
FIG. 8 is a front elevation view of an exemplary blade.
Figure 10:
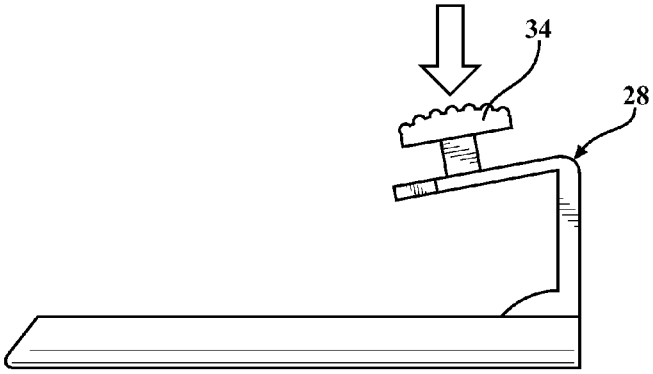
FIG. 10 shows the exemplary blade protector with a force being applied to a button on the blade protector.

Referring now to FIGS. 5-7, the blade protector 28 is generally J-shaped with a long leg (hereinafter referred to as a "protector portion") and a short leg (hereinafter referred to as an "actuator portion") when viewed from the side. As shown in FIG. 7, the protector portion has a channel 32 which is shaped to receive and cradle the sharp edge 26 of the blade 24. The actuator portion includes a button 34 which extends upwardly (through the top, bottom or either side of the housing/case 22) therefrom and projects out of the housing 22. The entire blade protector 28 is formed as one integral piece of a resiliently deflectable material which is strong enough to resist damage if it contacts the sharp edge 26 of the blade 24. One suitable material for the blade protector 28 is spring steel. However, it should be appreciated that any suitable metal or other sufficiently strong material may be employed. This allows the short leg of the J-shape to bend downwardly towards the long leg in response to a force being applied to the button 34. For example, FIG. 10 shows the short leg of the blade protector 28 being deflected in response to a force being applied thereto. When in a resting condition, the short leg of the blade protector 28 is biased against one side of the housing 22, and the housing 22 includes at least one locking detent 36 to establish a locking engagement between the blade protector 28 and the housing 22 to hold the blade protector 28 in the covering position shown in FIG. 1. Depressing the button 34 has the effect of disengaging the button 34 from the locking detent 36 to allow the blade protector 28 to be pushed or pulled between the retracted and covering positions discussed above.

Figure 9:
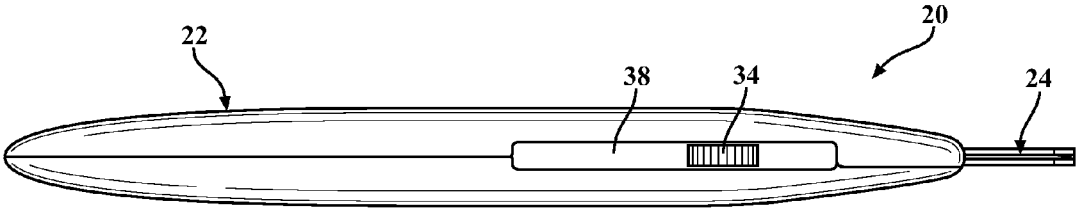
FIG. 9 is a top elevation view of the exemplary utility knife assembly.

As shown in FIG. 9, the button 34 projects out of the interior of the housing 22 through a longitudinally extending slot 38 formed in one side of the housing 22. In operation, a user may press in the button 34 to deflect the short leg of the J-shaped blade protector 28, thereby disengaging the button 34 from the locking detent 36 to allow the user to slide the blade protector 28 into and/or out of the housing 22. As such, the user may selectively expose and cover the sharp edge 26 of the blade 24 with the blade protector 28. The movement of the blade protector 28 is constrained by the longitudinal length of the slot 38 in the housing 22, i.e., the range of movement is limited by the length of the slot 38. As such, the slot 38 is preferably sized such that the sharp edge 26 of the blade 24 is fully protected when the button 34 is slid to one longitudinal end of the slot 38 and such that the sharp edge 26 of the blade 24 is fully exposed when the button 34 is slid to the opposite longitudinal end of the slot 38.

Since the blade protector 28 is built into the utility knife assembly 20, it cannot be misplaced or lost as often happens to other known blade covers.

Another aspect of the present invention provides for a method of protecting a sharp edge 26 of a blade 24 of a utility knife assembly 20, such as the utility knife assembly 20 described above. The method includes the step of moving a protector portion of a blade protector 28 from within the housing 22 to cover the portion which is outside of the housing 22 of the sharp edge 26 of the blade 24. Movement of the blade protector 28 between a retracted position and a covering position may be controlled by a button 34 on the blade protector 28 which projects outside of the housing 22 through one side thereof.

Obviously, many modifications and variations of the present invention are possible in light of the above teachings and may be practiced otherwise than as specifically described while within the scope of the appended claims.

What is claimed is:

1. A utility knife assembly, comprising:

a housing extending in a longitudinal direction between opposite longitudinal ends and having a top edge and a pair of sides and a bottom edge;

said housing including two pieces which are fixed together with a single fastener to provide an open interior between said pieces and one of said pieces having a pair of housing projections;

a blade having a sharp edge, said blade including a pair of notches that receive said housing projections of said housing to directly fix said blade with said housing such that said blade extends out of said open interior through one of said longitudinal ends of said housing, and said blade being non-moveable relative to said housing;

a blade protector partially disposed in said open interior of said housing and movable in said longitudinal direction relative to said housing between a retracted position wherein said sharp edge of said blade outside of said housing is exposed and a covering position wherein said sharp edge of said blade outside of said housing is covered by said blade protector;

said blade protector being J-shaped with a long leg transitioning into a intermediate leg which transitions into a short leg through a curve, said short leg being generally parallel to said long leg, said long leg cradling said sharp edge of said blade, and said short leg presenting a button which projects through a slot in said top edge of said housing and is depressable to unlock said blade protector from said housing such that said blade protector can move between said retracted and covering positions; and wherein at least one detent is recessed in at least one of said housing pieces to receive a button projection of said button to lock said blade protector in said covering position.

2. The utility knife assembly as set forth in claim 1 wherein said blade protector is made of one integral piece.

3. The utility knife assembly as set forth in claim 2 wherein said blade protector is made of metal.

4. The utility knife assembly as set forth in claim 3 wherein said blade protector is made of spring steel.

* * * * *